US005289234A

United States Patent [19]

Asano et al.

[11] Patent Number: 5,289,234

[45] Date of Patent: Feb. 22, 1994

[54] IMAGE FORMING APPARATUS WITH CHARGE BRUSH

[75] Inventors: Masaki Asano, Amagasaki; Shuji Iino, Hirakata; Akihito Ikegawa, Sakai; Izumi Osawa, Ikeda, all of Japan

[73] Assignee: Minolta Camera Kabushiki Kaisha, Osaka, Japan

[21] Appl. No.: 96,064

[22] Filed: Jul. 22, 1993

Related U.S. Application Data

[63] Continuation of Ser. No. 869,648, Apr. 16, 1992, abandoned.

[30] Foreign U.S. Application Data

Apr. 22, 1991 [JP] Japan ..... 3-90341[U]

[51] Int. Cl.[5] ..... G03G 15/02

[52] U.S. Cl. ..... 355/219; 355/211; 361/225

[58] Field of Search ..... 250/324, 325, 326; 361/220, 221, 215; 355/200, 210, 211, 219, 221, 224

[56] References Cited

U.S. PATENT DOCUMENTS

| | | | |
|---|---|---|---|
| 4,358,699 | 11/1982 | Wilsdorf | 310/251 |
| 4,387,980 | 6/1983 | Ueno et al. | 355/219 |
| 4,455,078 | 6/1984 | Mukai et al. | 355/219 |
| 4,987,446 | 1/1991 | Mochimaru et al. | 355/200 |
| 5,006,902 | 4/1991 | Araya | 355/219 |
| 5,012,282 | 4/1991 | Wanou et al. | 355/219 |
| 5,055,882 | 10/1991 | Fushimi | 355/269 |
| 5,060,016 | 10/1991 | Wanou et al. | 355/219 |
| 5,105,221 | 4/1992 | Takahashi et al. | 355/200 X |

FOREIGN PATENT DOCUMENTS

| | | |
|---|---|---|
| 56-147161 | 11/1981 | Japan . |
| 60-216363 | 10/1985 | Japan . |

*Primary Examiner*—Leo P. Picard
*Assistant Examiner*—Christopher Horgan
*Attorney, Agent, or Firm*—Willian Brinks Hofer Gilson & Lione

[57] ABSTRACT

An image forming apparatus having a detachable imaging cartridge which includes a photosensitive member charged by a charge brush having brush fibers. At least one of the photosensitive member and the charging brush is detachable from the imaging cartridge, and the detachable one is attached to the imaging cartridge through a guide member so that the brush fibers of the charge brush are indented toward a downstream side relative to a predetermined position of the charge brush with respect to the rotational direction of the photosensitive member.

22 Claims, 12 Drawing Sheets

IMAGE FORMING APPARATUS WITH CHARGE BRUSH

This application is a continuation of application Ser. No. 07/869,646, filed Apr. 16, 1992, abandoned.

BACKGROUND OF THE INVENTION

1. Field of the Invention

The present invention relates to an image forming apparatus such as copying apparatus, printers and the like, and more specifically relates to an image forming apparatus which electrically charges an electrostatic latent image bearing member by a charge brush.

2. Description of the Related Art

The image forming apparatus of copying machines, printers and the like electrically charge an electrostatic latent image bearing member such as a photosensitive drum or the like by means of a charging device. The electrically charged area of the aforesaid latent image bearing member is subjected to image exposure light so as to form a latent image thereon which is then developed so as to be rendered visible, and the developed image is then transferred onto a transfer sheet and fixed thereon.

Various types of the aforementioned charging device are known which can be broadly divided into two types: corona chargers which use a corona discharge, and contact chargers which induce contact between a charging brush, charging roller or rotatably driven endless belt used for charging and the surface of an electrostatic latent image bearing member.

Charging devices that use a corona discharge have the advantage of providing a stable discharge, but also have the disadvantage of generating excessive ozone which causes deterioration of the latent image bearing member and produces adverse physiological affects. The amount of ozone generated by contact type chargers is remarkably slight compared to that of corona chargers.

Among the aforementioned types of chargers, the brush charger has a charge brush of relatively simple construction which makes contact with and charges the surface of an electrostatic latent image bearing member, and is particularly effective with latent image bearing members having a moving surface.

The construction of the aforesaid charge brush is generally as shown in FIG. 1. A plurality of charge brush fibers F fixedly attached via adhesive or the like to a supporting member (back plate) P of aluminum or like material having a backing A. The brush B makes contact with the moving surface S of the electrostatic latent image bearing member PC.

Image forming apparatus which electrically charge the surface of an electrostatic latent image bearing member via a charge brush tend to have grouping or non-uniformity in the brush fibers of the charge brush that causes irregular charging and stripe-like image noise.

When the aforesaid brush fiber grouping and non-uniformity is produced in the opposite direction to the direction of movement of the surface of the electrostatic latent image bearing member, the rotational load of the latent image bearing member increases and fluctuates. The aforesaid load increase and fluctuation causes the latent image bearing member to fail to achieve a predetermined number of rotations and uneven rotation, thereby causing image defects.

Furthermore, when the image forming apparatus is stopped after use with the brush hair grouping and non-uniformity maintained in the opposite direction to the direction of movement of the surface of the latent image bearing member, the nonuniform brush hair state becomes the fixed regular shape of the brush due to the brush hair creep during this period. Therefore, it becomes difficult for the brush fibers to make suitable contact with the surface of the latent image bearing member even when said member is driven, and a fair amount of the brush hair remains inclined in the opposite direction to the direction of movement of the surface of the latent image bearing member.

There are thought to be various causes for the brush hair grouping and non-uniformity produced in the aforesaid type of charge brush. One reason is that the previously described unsuitable state of the brush fibers frequently occurs during the assembly of the charge brush and the latent image bearing member.

SUMMARY OF THE INVENTION

A main object of the present invention is to provide an image forming apparatus capable of producing excellent images without charge unevenness.

A further object of the present invention is to provide stable rotation of the electrostatic latent image bearing member in an image forming apparatus.

A still further object of the present invention is to provide an image forming apparatus which allows the charge brush and electrostatic latent image bearing member to be assembled so as to not produce brush hair grouping and non-uniformity.

These and other objects of the present invention are achieved by providing an image forming apparatus constructed so as to electrically charge an electrostatic latent image bearing member by means of a charge brush, said image forming apparatus being characterized by having a removable electrostatic latent image bearing member, charge brush for triboelectrically charging the surface of the electrostatic latent image bearing member, and guide means for installing the aforesaid electrostatic latent image bearing member so that the fibers of the charge brush are uniformly pressed toward the downstream side in the direction of movement of the surface of the latent image bearing member relative to a standard position of the charge brush in the image forming apparatus.

These and other objects of the present invention are further achieved by providing an image forming apparatus constructed so as to electrically charge an electrostatic latent image bearing member by means of a charge brush, said image forming apparatus being characterized by having an electrostatic latent image bearing member, removable charge brush for triboelectrically charging the surface of the electrostatic latent image bearing member, and guide means for installing the aforesaid charge brush so that the fibers of the charge brush are uniformly pressed toward the downstream side in the direction of movement of the surface of the latent image bearing member relative to a standard position of the charge brush in the image forming apparatus.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

The preferred embodiments of the present invention are described hereinafter with reference to the accompanying drawings.

The embodiments of the invention described below all relate to a printer having the basic construction shown in FIG. 2.

Figure 1:
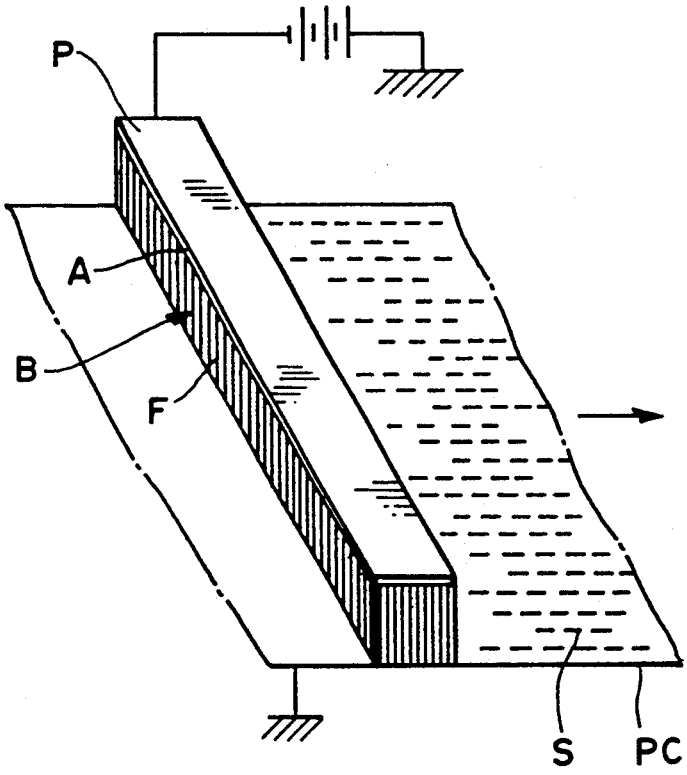
FIG. 1 is an illustration showing a conventional charge brush.
Figure 2:
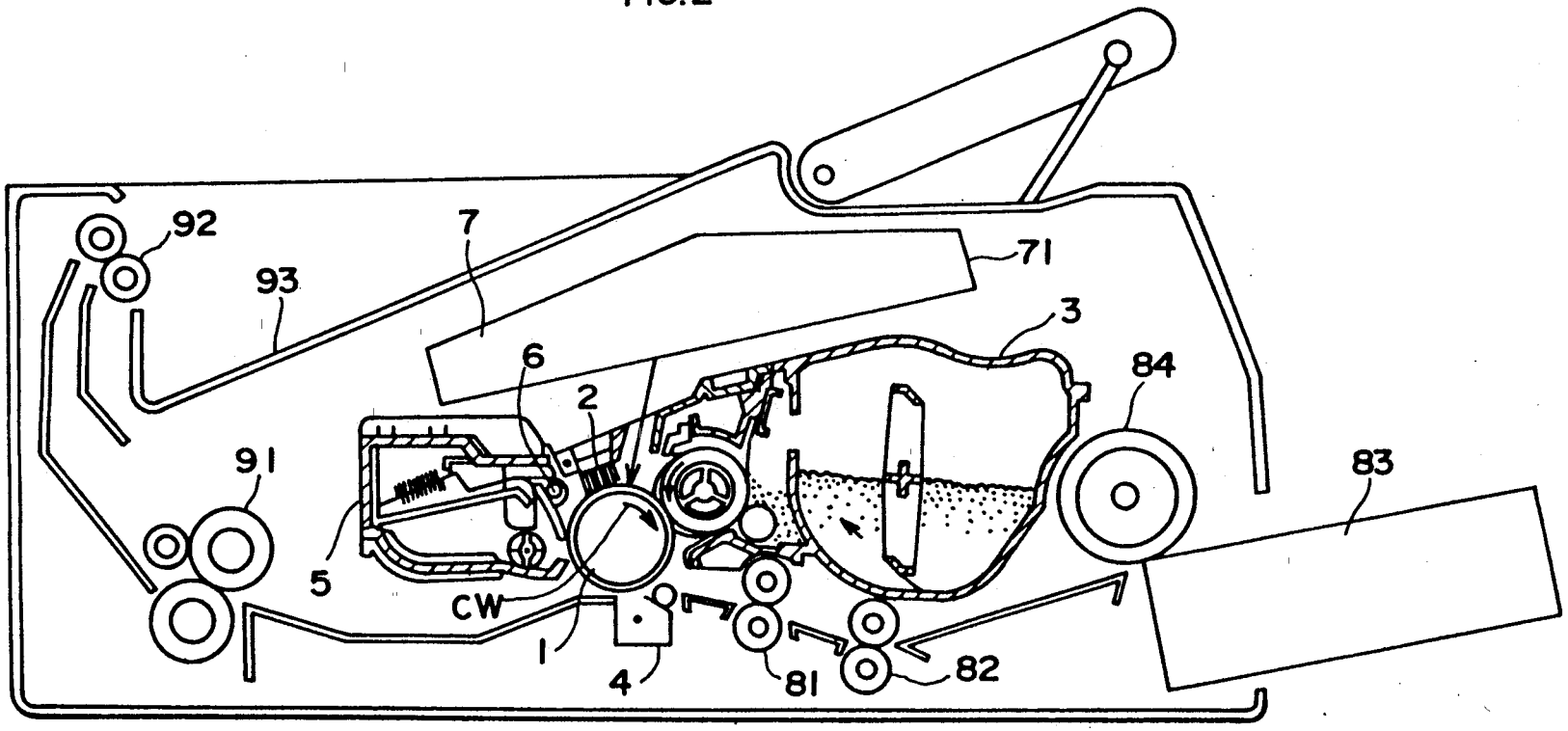
FIG. 2 briefly shows the basic construction of the an embodiment of the printer of the present invention.
Figure 3:
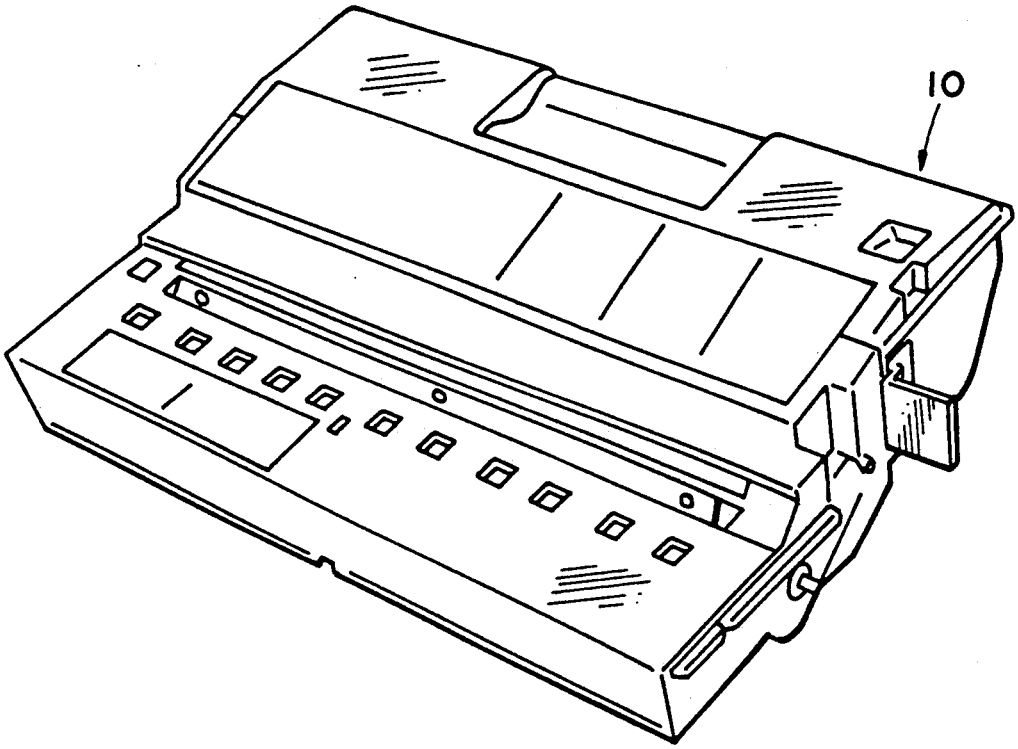
FIG. 3 is a perspective view showing the image cartridge in the printer of FIG. 2.

The printer shown in FIG. 2 is provided with a photosensitive drum 1 as the electrostatic latent image bearing member which is disposed in the center portion of the printer, and which is rotatably driven by a driving means (not shown in the drawing) in the arrow CW direction. Sequentially arranged around the periphery of the photosensitive drum 1 are charge brush 2, developing device 3, transfer charger 4, cleaning device 5, and eraser 6. The drum 1, charge brush 2, developing device 3, cleaning device 5, and eraser 6 are built into the imaging cartridge 10 (refer to FIG. 3) which is removably installed in the main body of the printer.

The optical system 7 is provided above the photosensitive drum 1. The optical system 7 comprises a semiconductor laser generator, polygonal mirror, toroidal lens, half-mirror, spherical mirror, folding mirror, reflecting mirror and the like disposed in a housing 71. An exposure slit is formed in the bottom portion of the housing 71 through which image exposure light can be projected between the charge brush 2 and the developing device 3 onto the surface of the photosensitive drum 1.

Sequentially arranged at the right side of the photosensitive drum 1 in the drawing are a pair of timing rollers 81, pair of intermediate rollers 82 and paper supply cassette 83, said cassette 83 confronting by a feed roller 84. Sequentially arranged to the left side of the drum 1 in the drawing are a pair of fixing rollers 91 and a pair of discharge rollers 92, said discharge rollers 92 confronting a discharge tray 93.

The aforementioned printer provides that the surface of the photosensitive drum 1 is electrically charged to a predetermined electric potential by the charging brush 2, and the charged area of the drum surface is then exposed by the image exposure light projected from the optical system 7 so as to form an electrostatic latent image thereon. The formed latent image is thereafter developed as a toner image via the developing device 3, and said toner image advances to the transfer region opposite the transfer charger 4.

On the other hand, a transfer sheet is fed from the cassette 83 by the feed roller 84, said transfer sheet passes through the pair of intermediate rollers 82 and is advanced to the pair of timing rollers 81 so as to arrive at the transfer region simultaneously with the toner image formed on the surface of the photosensitive drum 1. The aforesaid toner image on the drum 1 is transferred onto the transfer sheet in the transfer region via the action of the transfer charger 4, whereupon the transfer sheet is advanced to the pair of fixing rollers 91 which fix the toner image on the transfer sheet. Thereafter, the transfer sheet is discharged to the discharge tray 93 by the pair of discharge rollers 92.

After the toner image is transferred to the transfer sheet, the residual toner remaining on the surface of the photosensitive drum 1 is removed therefrom by the cleaning device 5, and the residual electric charge remaining on the surface of the drum 1 is removed therefrom by the eraser 6.

The system speed of the previously described printer (circumferential speed of the photosensitive drum 1) is 3.5 cm/second. The developing device 3 is a contact-type developing device which uses a monocomponent developing material to accomplish reverse developing.

The photosensitive drum used in the specific embodiments of the present invention and comparative examples which are described hereinafter was manufactured by the method described below. The photosensitive member was of the function-separated organic type using a negative electric charge and having a sensitivity to long wavelength light.

First, one part-by-weight (pbw) $\tau$-type nonmetallic phthalocyanine, 2 pbw polyvinylbutyral resin (degree of acetylation 3 molar % or less, degree of butylation 70 molar % or less, degree of polymerization 1000), and 100 pbw tetrahydrofuran were added to a ball mill pot and mixed for 24 hrs to produce the photosensitive coating fluid. The aforesaid photosensitive application fluid was used to coat the entire surface of a cylindrical aluminum substrate having a major diameter of 30 mm and a length of 240 mm via a dipping method. The coating was then dried, so as to form a charge-generating layer 0.4 $\mu$m in thickness.

Thereafter, 8 pbw hydrazone compound having the structural formula shown below, 0.1 pbw orange coloring (Sumiplast Orange 12, Sumitomo Kagaku K.K.), and 10 pbw polycarbonate resin (Panlite L-1250, Teijin Kasei K.K) were dissolved in a solvent comprising 180 pbw tetrahydrofuran so as to produce a fluid coating.

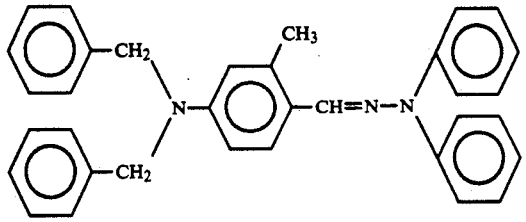

The fluid coating was then applied over the aforesaid charge-generating layer via a dipping method, and dried so as to form a charge-transporting layer having a thickness of 18 μm. The photosensitive drum 1 used in the present invention was produced by the above described method.

The τ-type nonmetallic phthalocyanine has, in case of using X-ray of $CuK\alpha_1$/Ni at a wavelength of 1.541 Å, X-ray diffraction diagram which discloses strong peaks at Bragg angles of 7.6, 9.2, 16.8, 17.4, 20.4, and 20.9 ($2\theta \pm 0.2$ degrees). The infrared absorption spectrum between 700 and 760 $cm^{-1}$ showed four of the most intense absorption bands at $751 \pm 2$ $cm^{-1}$, and two absorption bands of virtually identical intensity between 1320 and 1340 $cm^{-1}$, with distinctive absorption also at $3288 \pm 3$ $cm^{-1}$.

Electrostatic latent image bearing members suitable for the image forming apparatus of the present invention are not limited to the previously described members.

In the image forming system using a long wavelength light source such as a laser optical system, LED array or the like, photosensitive members may be used which have long wavelength sensitivity similar t that previously described. In image forming systems using a visible light source such as a liquid crystal shutter array, PLZT shutter array or the like, or visible light image forming systems using normal analog PPC lens and mirror optical system, photosensitive members may be used which have sensitivity in the spectral range.

Photosensitive members suitable for the present invention are not limited to the previously described construction inasmuch as a single-layer construction photosensitive member may be used as well as the aforesaid function-separated type photosensitive member. Furthermore, all the various commonly known materials may be used as the materials of the charge-generating layer and the materials of the charge-transporting layer. That is, inorganic materials such as zinc oxide, cadmium oxide, selenium alloy, amorphous silicon and the like, or organic materials in which phthalocyanine, azo compound and the like may be used as materials for the charge-generating layer, and hydrazone, styryl compounds and the like may be used as materials for the charge-transporting layer.

The outermost surface of the photosensitive member may be provided a protective overcoat layer. The protective overcoat layer may use materials such as ultraviolet-curing resins, cold setting resins, thermosetting resins and the like, resins containing a dispersion of resistance-regulating materials, thin layer materials such as metal oxides, metal nitrides, metal carbides, metal sulfides and the like deposited via vacuum vapor deposition, ion plating or the like, or unstable carbon layers or the like formed by plasma polymerization of hydrocarbon gases.

The substrate material may be electrically conductive materials, and is not limited to any specific material. The configuration of the substrate may be belt-like, flat plate-like, or drum-like in accordance with the image forming system.

When a light source emitting coherent light is used, the aforesaid substrate may be provided with a surface roughness or black coloration so as to prevent production of so-called interference patterns.

The toner used with the developing device 3 in the specific embodiments of the present invention and comparative examples which are described hereinafter was a negatively charging type having a constituent composition comprising 100 pbw bisphenol A-type polyester resin, 5 pbw carbon black MA#8 (Mitsubishi Kasei Kogyo K.K.), 3 pbw Bondoron S-34 (Orient Kagaku Kogyo K.K.), and 2.5 pbw bisucohru TS-200 (Sanyo Kasei Kogyo K.K.). The aforesaid compound was mixed, pulverized, and classified by well known methods, so as to produce a toner powder having a mean particle diameter of 10 μm and wherein particle diameters of 80 pbw are distributed in the range of 7–13 μm. Hydrophobic silica (Talko Co., Tanorakksu 500) at 0.75 pbw was added to aforesaid toner particles as a fluidizing agent, and the mixture was mixed in a homogenizer.

The aforesaid toner was accommodated in the previously mentioned developing device 3 and used for image developing.

Figure 4:
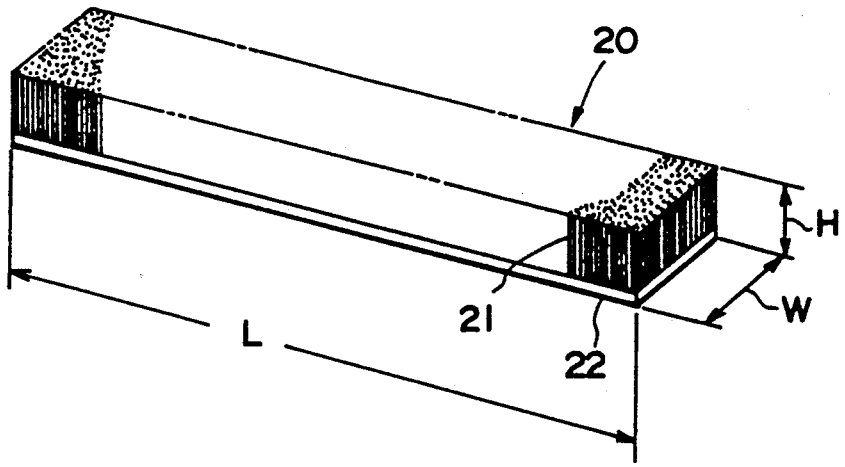
FIG. 4 is a perspective view showing the basic construction of the charge brush.

The charge brush 2 in the previously described printer may be constructed, for example, so that the brush portion 20 may have a band-like pile, as shown in FIG. 4.

The aforesaid pile may be obtained by, for example, weaving the brush fibers 21 comprising electrically conductive fibers of 3–10 deniers to a backing 22 applying an electrically conductive adhesive coating to back surface of the backing portion.

Figure 5:
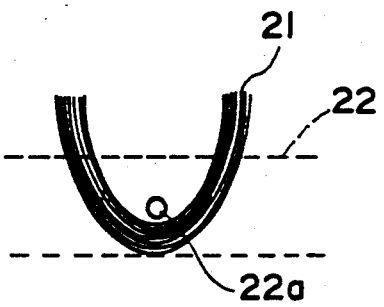
FIGS. 5 (A) and (B) are illustrations showing the weave toward the backing of the brush fibers in the charge brush.
Figure 5:
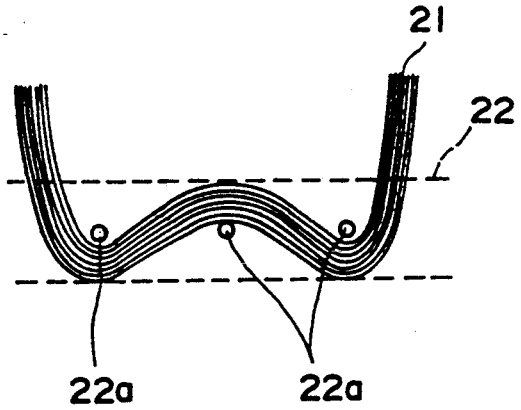

The brush fibers, for example, in a bundle of 50 to 100 fibers woven in a V-shape to a thread **22*a* on a backing 22, as shown in FIG. 5A, or woven in a W-shape as shown in FIG. 5B. The brush 20** is fixedly attached to a support member (back plate) via the aforesaid adhesive.

Figure 6:
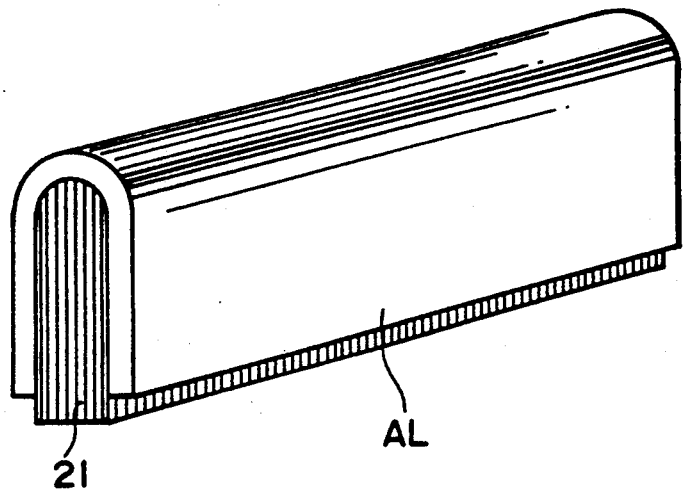
FIG. 6 is a perspective view showing another example of the charge brush.

Furthermore, a brush support plate AL which is capable of opening and closing to grip the brush fibers 21 may be considered as a charge brush, as shown in FIG. 6. This type of brush is also suitable for use with the present invention.

The brush fiber material may be a suitable electrically conductive material and is not limited to any specific material.

Metal wires such as tungsten, stainless steel, gold, platinum, iron, copper, aluminum and the like may be used as the electrically conductive material.

Examples of useful electrically conductive resin materials may include carbon black, carbon fibers, metal particles, met-allic whiskers, metal oxides, semiconductors and the like used as resistance-adjusting agents dispersed in fibers such as rayon, nylon, acetate, coproammonium, vinylidene, vinylon, ethylene fluoride, promix, benzoate, polyurethane, polyester, polyethylene, polyvinyl chloride, polychlal, polynosic, polypropylene and the like. In this case, a suitable and desirable resistance value can be obtained by the dispersion amount. Alternatively, the fiber surface may be covered by a resistance-adjusting material, or conversely, the surface of low resistance fibers may be covered by a high resistance resin.

The charge brush 2 used in the specific embodiments of the present invention and comparative examples which are described hereinafter was provided brush fibers 21 comprising rayon fibers containing conductive carbon powder at a rate of 12 pbw relative to total weight. The aforesaid fibers had an electrical resistance of $1\times10^5$ Ωcm, fiber thickness was 6 deniers, density was 15,000 fibers/cm$^2$, and were woven to the backing 22 in a W-shaped weave. The backing 22 is fixedly attached to the aluminum back plate. The dimensions of each portion of the brush were length (L) of 240 mm, width (W) of 10 mm, and height (H) of 5 mm, as shown in FIG. 4.

The examples of the printer of the present invention and comparative examples are described sequentially hereinafter, following a description of the methods used to evaluate image noise based on charge unevenness on the surface of the photosensitive drum 1 imparted by the charge brush 2.

Charge unevenness is generated and distributed in the direction intersecting the direction of travel of the photosensitive drum 1 surface. The charge unevenness remains as electric potential $V_i$ unevenness even after image light exposure. That is, if the electric potential $V_0$ immediately after charging by the charge brush 2 has components which are partially high potential, the potential $V_i$ is also partially high after image light exposure.

When reverse developing is accomplished in the previously described printer, the low potential portion of the potential $V_i$ is developed with excessive toner. That is, the potential $V_0$ unevenness becomes potential $V_i$ unevenness, and ultimately image unevenness. One property of the apparatus of the present invention is that the occurrence of image unevenness can be prevented. The degree of image unevenness was evaluated via the image noise evaluation method described below.

Figure 7:
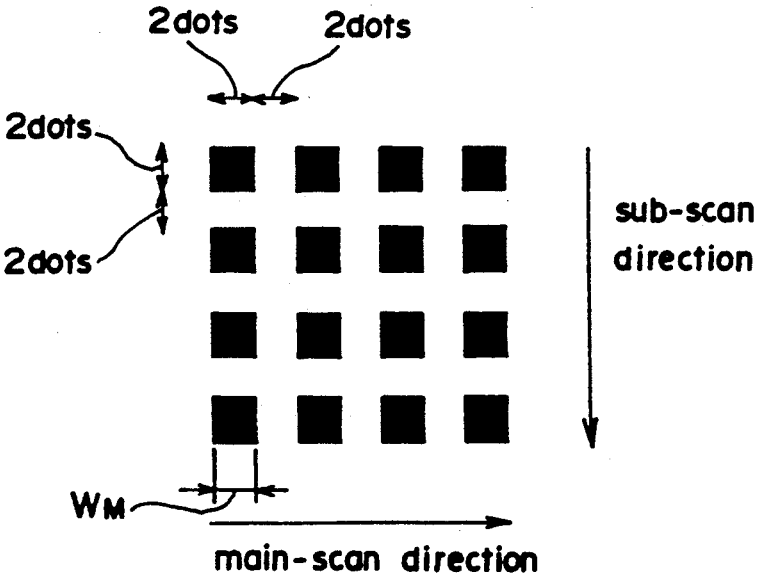
FIG. 7 is an illustration showing a print image sample used for image evaluation.
Figure 8:
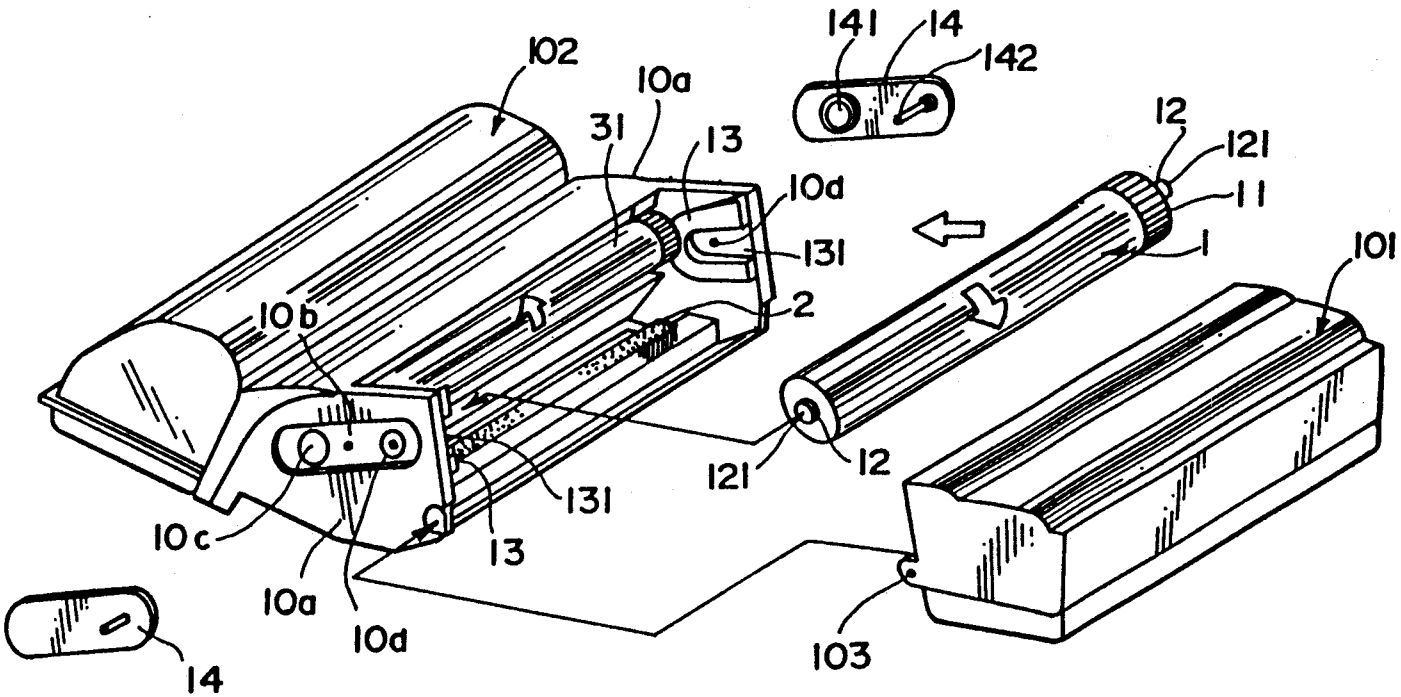
FIG. 8 is an exploded perspective view showing the imaging cartridge in a first embodiment of the present invention.
Figure 9:
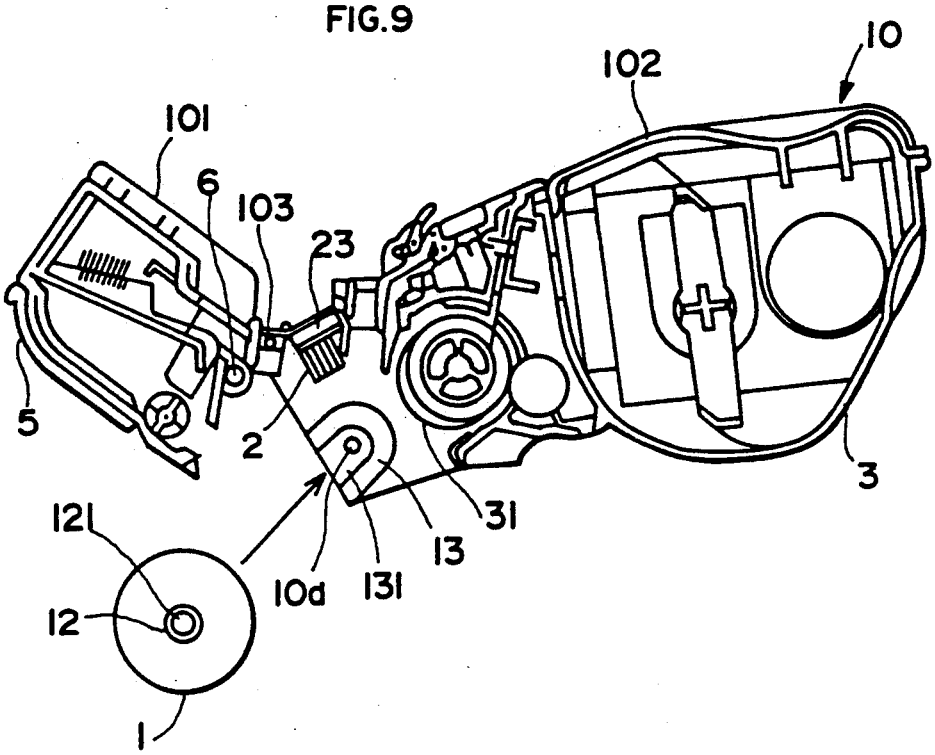
FIG. 9 is an exploded section view of the imaging cartridge of FIG. 8.

Image noise was evaluated as follows. Using the previously described printer, the surface of the photosensitive drum was charged by the charge brush 2, and exposed via a laser beam emitted from the optical system 7 wherein the emission timing of said laser was regulated so as to repeatedly write a pattern of two dots ON (lighted), two dots OFF (extinguished) in the main scan direction, and similarly repeatedly write a pattern of two dots ON (lighted), two dots OFF (extinguished) in the sub-scan direction. Thereafter, reverse developing, transfer, and fixing processes were accomplished to produce the print image shown in FIG. 7.

The maximum width of the small solid pattern comprising the aforesaid two dot-by-two dot area on the print image in the main scan direction was designated $W_M$. The standard deviation of the maximum width $W_M$ of 30 consecutive individual solid patterns in the main scan direction was designated ó, and the following stripe-like image noise ranking was devised via the aforesaid value ó.

| Standard Deviation $\sigma$ | Evaluation Symbol |
|---|---|
| $0\ \mu m \leqq \sigma < 20\ \mu m$ | ○ |
| $20\ \mu m \leqq \sigma$ | X |

A large standard deviation ó means the width of the small solids in the main scan direction shows a large degree of non-uniformity in the main scan direction.

In the image evaluation symbols, the symbol 0 indicates the state wherein the stripe-like image noise was not confirmable or the image noise did not hinder practical applications. The symbol X indicates the state wherein image noise did hinder practical applications.

Specific embodiments of the present invention and comparative examples are described in sequence hereinafter.

EXAMPLE 1

The printer of the first example is constructed as shown in FIG. 2 and uses the imaging cartridges 10 shown in FIGS. 8 through 11.

The cartridge 10 is constructed so that the portion 101 containing the erase 6 and cleaning device 5 is openable by rotating on a pivot 103 relative to the portion 102 containing the charge brush 2 and developing device 3. The charge brush 2 is fixedly attached to the portion 102 from the beginning, and the photosensitive drum 1 is removably installed in the portion 102.

The gear 11 is fixedly mounted to one end of the photosensitive drum 1 so as to have the same rotational axis direction as the drum 1. A rotating shafts 12 extends through both ends of the drum 1, and holes 121 are provided at the end of each rotating shaft 12.

Figure 10:
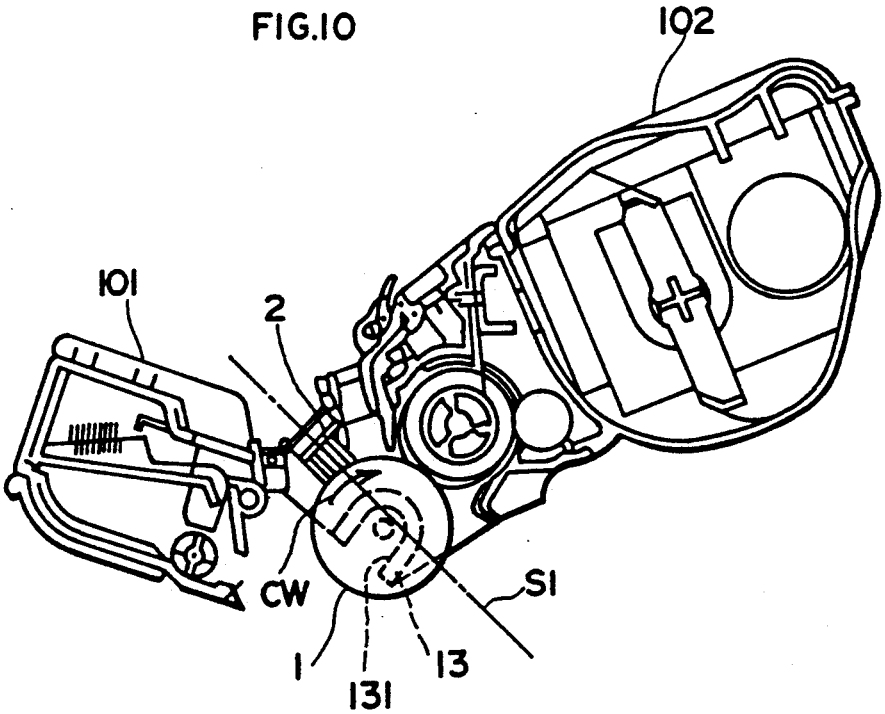
FIG. 10 is a section view showing the installation of the photosensitive drum of the cartridge of FIG. 8.

Both rotating shafts 12 can engage grooves 131 of the guide members 13 provided on the inner surfaces of both side panels **10*a* positioned to accommodate the drum 1 within the portion 102. Accordingly, as shown in FIG. 10, the drum i is arranged in the standard position from the upstream side of the charge brush 2 by pressing both shafts 12 so as to have said shafts 12 engage the grooves 131. By means of this drum arrangement, the brush fibers of the charge brush 2 are uniformly pressed toward the downstream side from the brush 2 position in the direction CW of travel of the photosensitive drum 1 surface. Furthermore, the drum 1 makes contact with the developing sleeve 31 of the developing device 3. The item S1 in FIG. 10 is the boundary of the upstream and downstream sides of the charge brush 2 (refer to FIG. 12**).

The stoppers 14 are provided on the exterior side of both side panels **10*a* of portion 102. Each stopper 14 has a cylindrical projection 141 which engages a hole (not illustrated) in the end face of the drive rollers provided inside the developing sleeve 31, and a projection 142 which engages the end face hole 121 of the drum shaft 12. Each side panel 10*a* is provided with a concavity 10*b* which engages the stopper 14, and holes 10*c* and 10*d* through which both projections 141 and 142 penetrate. Accordingly, by arranging the developing sleeve 31, sleeve drive roller and drum 1 at standard positions, and penetrating the projections 141 and 142 of the stoppers through the through holes so as to engage the end face hole of the sleeve drive roller and the drum shaft end face hole 121**, the aforesaid sleeve and drum can be installed at their standard positions.

Figure 11:
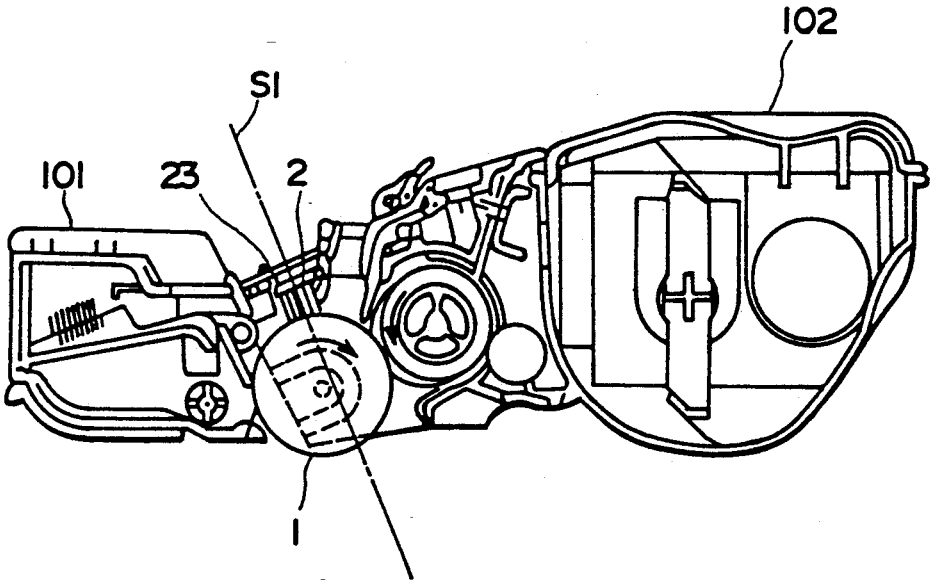
FIG. 11 is a section view showing the cartridge of FIG. 8 after assembly.

After the drum 1 is installed, the portion 101 is closed and the imaging cartridge 10 is completed, as shown in FIG. 11. The amount of indentation of the charge brush 2 toward the photosensitive drum 1, i.e., toward the center of the drum 1 from the standard position where the leading end of the brush contacts the drum 1, is 1.5 mm.

The cartridge 10 was assembled in the printer of FIG. 2, and the photosensitive drum 1 was rotated in the aforementioned CW direction at a circumferential speed of 3.5 cm/second. On the other hand, the a direct current (DC) voltage of about −1.1 kV was applied to the charge brush 2 through the aluminum back plate 23 of said brush 2 so as to impart a mean electrical charge of −750V to the surface of the drum 1. The charged area of the drum 1 was exposed to image light exposure so as to form an electrostatic latent image thereon corresponding to the pattern shown in FIG. 7, said latent image was then developed by the developing device 3 via a developing bias voltage of about −300V, the developed image was transferred onto a transfer sheet and fixed thereon.

Stripe-like noise evaluation of the produced image resulted in a ranking of O.

EXAMPLE 2

The printer of the second example is constructed as shown in FIG. 2 and uses an imaging cartridges 10 having the same construction as the cartridge 10 of the first example. The amount of indentation of the charge brush was 2.5 mm.

The aforesaid cartridge was assembled in the printer, and operated under the same operating conditions as described in the first example. Images were formed and evaluated for stripe-like noise. The noise ranking was O.

REFERENCE EXAMPLE 1

Figure 12A:
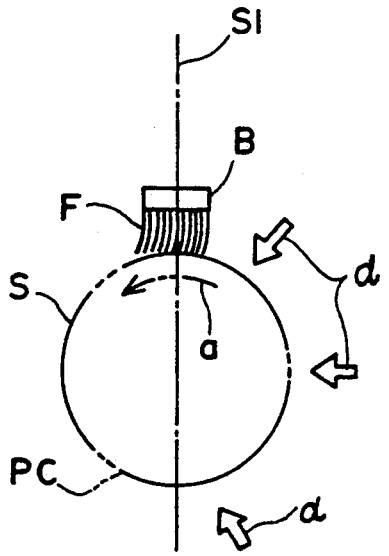
FIGS. 12 (A) and (B) are illustrations showing installation directions of the electrostatic latent image bearing member of the present invention and Reference Examples.
Figure 12B:
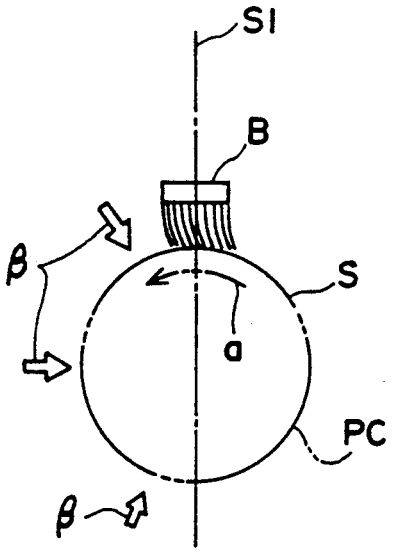

The printer of reference example 1 used the imaging cartridge 10 provided with the photosensitive drum 1 installed on the downstream side of the charge brush 2, as shown in FIG. 12B. The amount of indentation of the charge brush was 1.5 mm.

The aforesaid cartridge was assembled in the printer and operated under operating conditions identical to those of the first example. Images were formed and evaluated for stripe-like noise. The noise ranking was X.

In this example, part of the brush fibers of the charge brush 2 was nonuniform, i.e., set in the reverse direction relative to the travel direction of the drum surface.

REFERENCE EXAMPLE 2

The printer had the same construction as in the first reference example, with the exception that the amount of indentation of the charge brush 2 was 2.5 mm.

When this device was operated under the same operating conditions as in the first example, the drum 1 had insufficient rotation. In this example also, part of the brush fibers of the charge brush 2 was nonuniform, i.e., set in the reverse direction relative to the travel direction of the drum surface. It is believed that the aforesaid rotational insufficiency was produced by a marked increase in the rotational torque of the drum 1 due to the large indentation of the charge brush 2.

EXAMPLE 3

Figure 13:
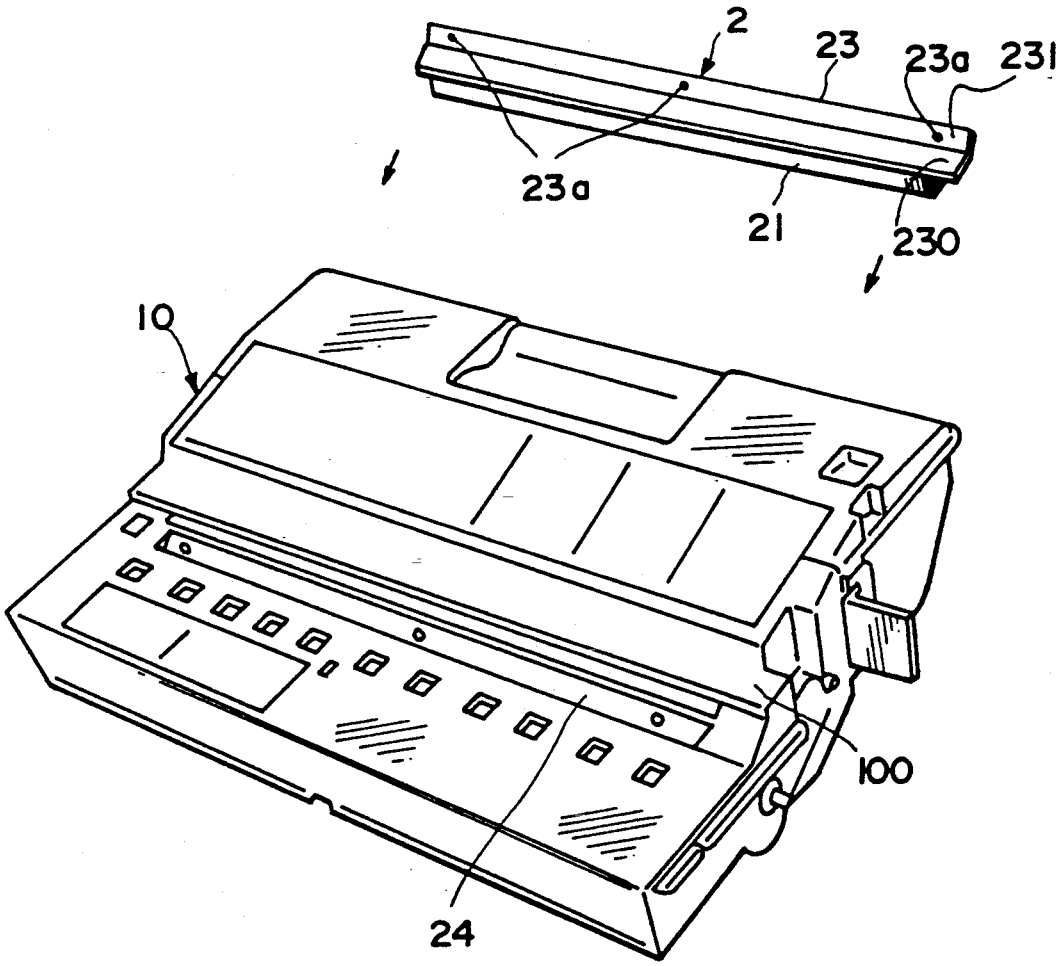
FIG. 13 is an exploded perspective view of the imaging cartridge in a second embodiment of the present invention.
Figure 14:
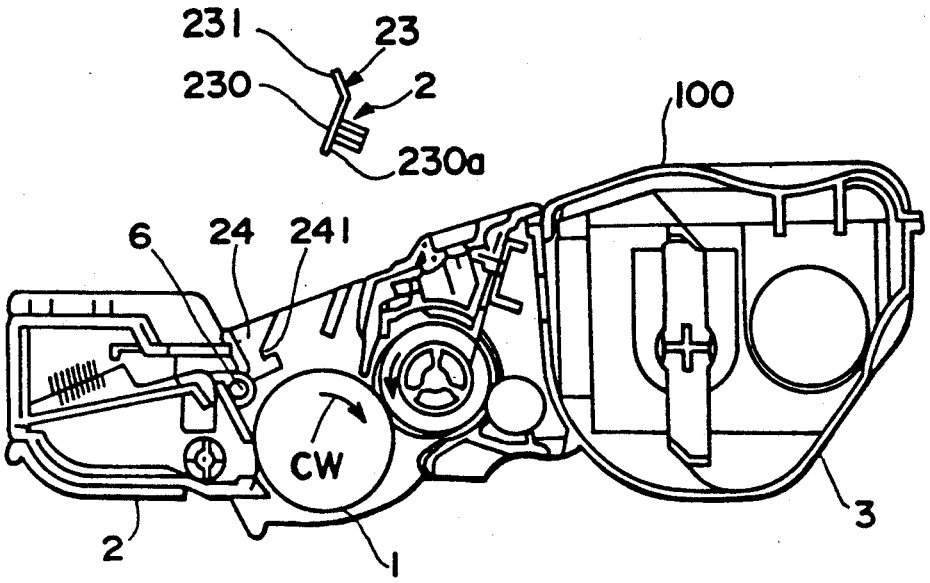
FIG. 14 is an exploded section view of the image cartridge of FIG. 13.

The construction of the printer of example 3 is shown in FIG. 2. This printer used the imaging cartridge 10 constructed as shown in FIGS. 13 and 14.

The cartridge 10 was provided with the photosensitive drum 1 arranged at the standard position from the beginning, so as to allow the charge brush 2 to be removably installed in the cartridge. The cartridge case 100 had a charge brush installation guide 24 provided with brush insertion apertures in the part at which the charge brush was to be installed. The aluminum back plate 23 of the charge brush 2 had a portion 230 for supporting the brush and an inclined portion 231 rising from said portion 230, both portions 230 and 231 being integratedly formed as a unit. The portion 231 was provided screw holes 23*a*.

Figure 15:
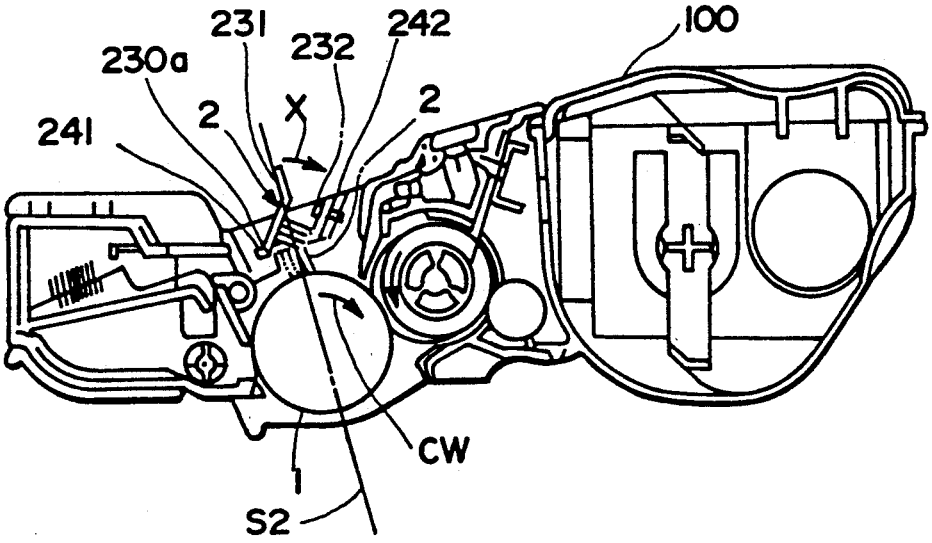
FIG. 15 is a section view showing the cartridge of FIG. 13 just before assembly is completed.

The charge brush installation guide 24 of the cartridge case 100 is provided with a concave portion 241 which engages the leading end 230*a* of the brush support portion 230 on the back plate. The charge brush 2 is inserted toward the installation guide 24 so that the leading end 230*a* engages the concave portion 241, and thereafter the brush 2 is rotated in the arrow X direction, as shown in FIG. 15, so that the back plate portion 231 attached to the guide panel 242 by a screw 232 placed through the screw hole 23*a*, as indicated by the dashed line in the drawing. In this state, the amount of indentation of the charge brush 2 toward the photosensitive drum 1 is 1.5 mm.

The installation of the charge brush 2 is accomplished from the downstream side (refer to FIGS. 16*a*–16*d*) of the boundary S2 between the upstream and downstream sides of the drum 1, as shown in FIG. 15. The fibers of the charge brush installed at the standard position are pressed toward the downstream side from the standard position of the charge brush on the drum 1.

The cartridge 10 was assembled in the printer of FIG. 2 and operated under operating conditions identical to those of the first example. Images were formed and evaluated for stripe-like noise. The ranking was O.

EXAMPLE 4

The construction of the printer was the same as that in the third example, with the exception that the amount of indentation of the charge brush was 2.5 mm.

The apparatus was operated under operating conditions identical to those of the first example. Images were formed and evaluated for stripe-like noise. The ranking was O.

REFERENCE EXAMPLE 3

The printer of reference example 3 used an imaging cartridge 10 with the charge brush 2 installed from the downstream side of the plane S2. The amount of indentation of the charge brush was 1.5 mm.

The aforesaid cartridge was assembled in the printer and operated under operating conditions identical to those of the first example. Images were formed and evaluated for stripe-like noise. The ranking was X.

In the present example, part of the brush fibers of the charge brush 2 was nonuniform, i.e., set in the reverse direction relative to the travel direction of the drum surface.

REFERENCE EXAMPLE 4

The construction of the printer was identical to that used in reference example 3, with the exception that the amount of indentation of the charge brush 2 was 2.5 mm.

When the aforesaid apparatus was operated under operating conditions identical to those of example 1, the drum 1 had insufficient rotation. In this example also, part of the brush fibers of the charge brush 2 was nonuniform, i.e., set in the reverse direction relative to the travel direction of the drum surface. It is believed that the aforesaid rotational insufficiency was produced by a marked increase in the rotational torque of the drum 1 due to the large indentation of the charge brush 2.

As can be clearly understood from the preceding description, the present invention provides that when the charge brush is installed first at a predetermined standard position and the electrostatic latent image bearing member is removably installed relative to the charge brush, the installation direction of said latent image bearing member relative to the charge brush is the direction $\alpha$ shown in FIG. 12A. That is, at the boundary of the plate S1 formed by the direction of the brush fibers F at the center of the charge brush B (mean direction if non-uniform) and a line perpendicular to the direction of travel of the surface S of the electrostatic latent image bearing member PC, when the entrance side of initial contact between the charge brush B and an optional point on the surface of the latent image bearing member PC is designated the upstream side, and the exit side where the optional point is separated from the charge brush B is designated the downstream side, the direction from the upstream side toward the downstream side is the arrow $\alpha$ direction. The direction $\beta$ from the downstream side toward the upstream side is prohibited, as shown in FIG. 12B.

Figure 16A:
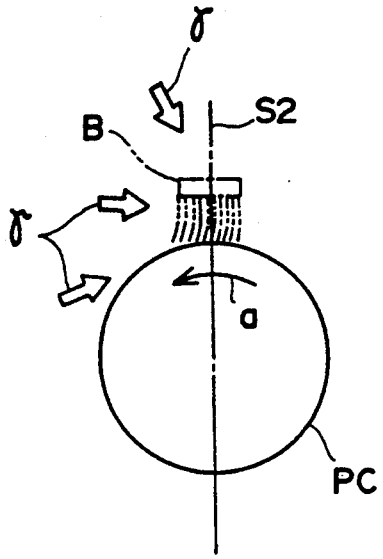
FIGS. 16 (A) to (D) are illustrations showing installation directions of the charge brush of the present invention and Reference Examples.
Figure 16B:
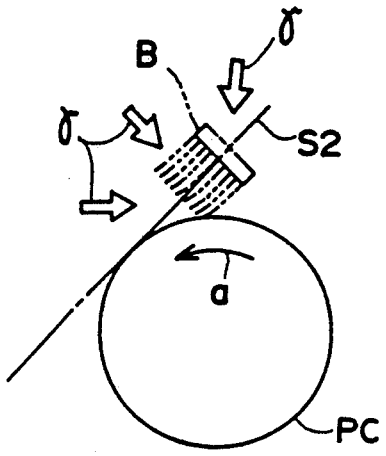
Figure 16C:
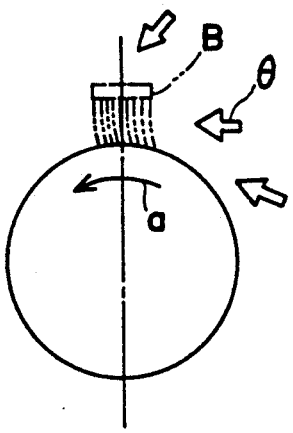
Figure 16D:
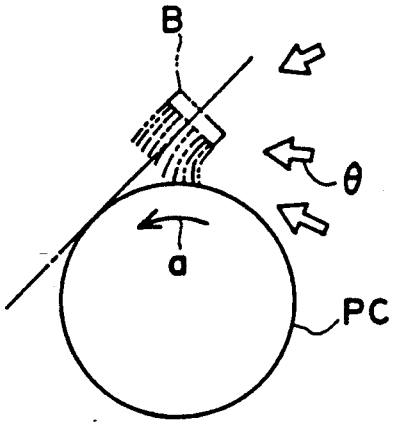

Furthermore, when the electrostatic latent image bearing member PC is installed first at the predetermined standard position and the charge brush is removably installed relative to the aforesaid image bearing member, the installation direction of said charge brush relative to the latent image bearing member is the direction $\gamma$ shown in FIGS. 16A and 16B. That is, assuming the charge brush B is positioned at a standard position relative to the electrostatic latent image bearing member PC, at the boundary of the plane S2 formed by the direction of the brush fibers F at the center of the charge brush B (mean direction if non-uniform) and a line perpendicular to the direction of travel of the surface S of the electrostatic latent image bearing member PC, when the entrance side of initial contact between the charge brush B and an optional point on the surface of the latent image bearing member PC is designated the upstream side, and the exit side where the optional point is separated from the charge brush B is designated the downstream side, the direction from the downstream side toward the upstream side is the arrow $\gamma$ direction. The direction $\theta$ from the upstream side toward the downstream side is not included, as shown in FIGS. 16C and 16D.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus comprising:
an image bearing member;
a charge brush having brush fibers for charging the surface of said image bearing member by contacting the fibers therewith;
a holder for rotatably holding said image bearing member and for holding said charge brush in contact with said image bearing member, said holder detachably holding at least one of said image bearing member and said charge brush; and
guide means for relatively guiding said detachable one into said holder from a predetermined direction so that said fibers of said charge brush are inclined along the rotational direction of said image bearing member.

2. The image forming apparatus as claimed in claim 1, wherein said image bearing member is made of organic photoconductor and said fibers of said charge brush are made of macromolecule material.

3. An image forming apparatus comprising:
an image bearing member;
a charge brush having brush fibers for charging the surface of said image bearing member by contacting the fibers therewith;
a holder for rotatably and detachably holding said image bearing member and for holding said charge brush in contact with said image bearing member; and
guide means for guiding said image bearing member into said holder from an upstream side of said charge brush with respect to the rotational direction of said image bearing member.

4. The image forming apparatus as claimed in claim 3, wherein said image bearing member is made of organic photoconductor and said fibers of said charge brush are made of macromolecule material.

5. The image forming apparatus as claimed in claim 3, wherein said holder is an imaging cartridge which is detachably disposed in said image forming apparatus.

6. An image forming apparatus comprising:
an image bearing member;
a charge brush having brush fibers for charging the surface of said image bearing member by contacting the fibers therewith;
a holder for rotatably holding said image bearing member and for detachably holding said charge brush in contact with said image bearing member; and
guide means for guiding said charge brush into said holder from an opposite direction with respect to the rotational direction of said image bearing member.

7. The image forming apparatus as claimed in claim 6, wherein said image bearing member is made of organic photoconductor and said fibers of said charge brush are made of macromolecule material.

8. The image forming apparatus as claimed in claim 6, wherein said holder is an imaging cartridge which is detachably disposed in said image forming apparatus.

9. An imaging cartridge detachably provided in an image forming apparatus comprising:
an image bearing member being held rotatably and detachably in said imaging cartridge;
a charge brush having brush fibers for charging the surface of said image bearing member by contacting the fibers therewith, said charge brush being fixedly held in said imaging cartridge; and
guide means provided on the inner surface of a side wall of said imaging cartridge for guiding said image bearing member into said imaging cartridge from an upstream side of said charge brush with respect to the rotational direction of said image bearing member.

10. The imaging cartridge as claimed in claim 9, wherein said image bearing member is made of organic photoconductor and said fibers of said charge brush are made of macromolecule material.

11. The imaging cartridge as claimed in claim 9, further comprising a first part and a second part which is openable by rotation on a pivot relative to said first part, wherein said image bearing member is attached to said imaging cartridge through an opening space when said second part is opened.

12. The imaging cartridge as claimed in claim 11, wherein said first part includes a developing device and said charge brush, and said second part includes an eraser and a cleaning device.

13. The imaging cartridge as claimed in claim 12, wherein said guide means is provided in said first part.

14. An imaging cartridge detachably provided in an image forming apparatus comprising:

an image bearing member being rotatably held in said imaging cartridge;

a charge brush having brush fibers for charging the surface of said image bearing member by contacting the fibers therewith, said charge brush being detachably held in said imaging cartridge; and guide means for guiding said charge brush into said imaging cartridge from an opposite direction with respect to the rotational direction of said image bearing member.

15. The imaging cartridge as claimed in claim 14, wherein said image bearing member is made of organic photoconductor and said fibers of said charge brush are made of macromolecule material.

16. The imaging cartridge as claimed in claim 14, wherein said guide means has a concave portion with which the edge of said charge brush engages.

17. In an image forming apparatus which includes a rotatable and detachable image bearing member and a charge brush having brush fibers for charging the surface of said image bearing member by contacting the fibers therewith, a method for attaching the image bearing member to a frame provided in said image forming apparatus comprising the following steps of:

fixedly providing the charge brush in said frame; and inserting said image bearing member into said frame from an upstream side of said charge brush with respect to the rotational direction of said image bearing member.

18. In an image forming apparatus as claimed in claim 17, wherein said image bearing member is made of organic photoconductor and said fibers of said charge brush are made of macromolecule material.

19. In an image forming apparatus as claimed in claim 17, wherein said frame is provided in an imaging cartridge which is detachably provided in said image forming apparatus.

20. In an image forming apparatus which includes a rotatable image bearing member and a detachable charge brush having brush fibers for charging the surface of said image bearing member by contacting the fibers therewith, a method for attaching the charge brush to a frame provided in said image forming apparatus comprising the following steps of:

fixedly providing the image bearing member in said frame; and inserting said charge brush into said frame from an opposite direction with respect to the rotational direction of said image bearing member.

21. In an image forming apparatus as claimed in claim 20, wherein said image bearing member is made of organic photoconductor and said fibers of said charge brush are made of macromolecule material.

22. In an image forming apparatus as claimed in claim 20, wherein said frame is provided in an imaging cartridge which is detachably provided in said image forming apparatus.

* * * * *

UNITED STATES PATENT AND TRADEMARK OFFICE

CERTIFICATE OF CORRECTION

PATENT NO. : 5,289,234

DATED : February 22, 1994

INVENTOR(S) : Masaki Asano, et al

It is certified that error appears in the above-indentified patent and that said Letters Patent is hereby corrected as shown below:

On the Cover Page, Left-Hand Column, in item "[63]" change "Serial No. 869,648" to -- Serial No. 869,646 --.

On the Cover Page, Left-Hand Column, in item "[30]", change "3-90341[U]" to -- 3-90341 --.

In Col. 8, line 34, change "drum i" to -- drum 1 --.

Signed and Sealed this

Sixth Day of September, 1994

Bruce Lehman

*Attest:*

BRUCE LEHMAN

*Attesting Officer*

*Commissioner of Patents and Trademarks*